US010138437B2

(12) United States Patent
Okamoto et al.

(10) Patent No.: US 10,138,437 B2
(45) Date of Patent: Nov. 27, 2018

(54) WATER-SOLUBLE LUBRICANT OIL

(71) Applicant: SANYO CHEMICAL INDUSTRIES, LTD., Kyoto (JP)

(72) Inventors: Tsuyoshi Okamoto, Kyoto (JP); Yoshitaka Katsukawa, Kyoto (JP); Yusuke Yamazaki, Kyoto (JP); Toshiki Kojima, Kyoto (JP); Tsuyoshi Fukushima, Kyoto (JP); Mitsumasa Kamura, Kyoto (JP)

(73) Assignee: SANYO CHEMICAL INDUSTRIES, LTD., Kyoto (JP)

( * ) Notice: Subject to any disclaimer, the term of this patent is extended or adjusted under 35 U.S.C. 154(b) by 0 days.

(21) Appl. No.: 14/910,755

(22) PCT Filed: Aug. 21, 2014

(86) PCT No.: PCT/JP2014/071850
§ 371 (c)(1),
(2) Date: Feb. 8, 2016

(87) PCT Pub. No.: WO2015/025910
PCT Pub. Date: Feb. 26, 2015

(65) Prior Publication Data

US 2016/0186085 A1 Jun. 30, 2016

(30) Foreign Application Priority Data

Aug. 21, 2013 (JP) ..... 2013-171664
Feb. 7, 2014 (JP) ..... 2014-022848

(51) Int. Cl.

| | |
|---|---|
| ***C10M 133/08*** | (2006.01) |
| ***C10M 169/04*** | (2006.01) |
| ***C10M 169/02*** | (2006.01) |
| ***C10M 105/36*** | (2006.01) |
| ***C10M 105/68*** | (2006.01) |
| ***C10M 105/18*** | (2006.01) |
| ***C10M 119/08*** | (2006.01) |
| ***C10M 173/02*** | (2006.01) |
| ***C10M 105/40*** | (2006.01) |

(52) U.S. Cl.

CPC ..... *C10M 133/08* (2013.01); *C10M 105/18* (2013.01); *C10M 105/36* (2013.01); *C10M 105/40* (2013.01); *C10M 105/68* (2013.01); *C10M 119/08* (2013.01); *C10M 169/02* (2013.01); *C10M 169/04* (2013.01); *C10M 173/02* (2013.01); *C10M 2207/0225* (2013.01); *C10M 2207/0406* (2013.01); *C10M 2207/2895* (2013.01); *C10M 2209/1075* (2013.01); *C10M 2215/042* (2013.01); *C10M 2215/0425* (2013.01); *C10N 2220/021* (2013.01); *C10N 2230/06* (2013.01); *C10N 2230/12* (2013.01); *C10N 2240/02* (2013.01); *C10N 2240/04* (2013.01); *C10N 2240/08* (2013.01)

(58) Field of Classification Search

CPC ..... C10N 2240/08; C10N 2220/021; C10N 2230/06; C10N 2240/02; C10N 2230/12; C10M 133/08; C10M 169/04; C10M 105/40; C10M 105/36; C10M 105/68; C10M 105/18; C10M 119/08; C10M 173/02; C10M 2215/0425; C10M 2209/1075; C10M 2207/2895; C10M 2207/0225; C10M 2207/0406; C10M 2215/042; C10M 169/02

See application file for complete search history.

(56) References Cited

U.S. PATENT DOCUMENTS

| | | | | |
|---|---|---|---|---|
| 2001/0012821 | A1* | 8/2001 | Koishikawa | C10M 141/00 508/416 |
| 2003/0027729 | A1* | 2/2003 | Kaimai | C10M 169/04 508/280 |
| 2003/0176302 | A1* | 9/2003 | Li | C10M 111/04 508/532 |
| 2006/0135377 | A1* | 6/2006 | Li | C10M 173/025 508/389 |
| 2006/0217275 | A1* | 9/2006 | Imai | C10M 169/044 508/321 |
| 2007/0010406 | A1* | 1/2007 | Okamoto | C10M 173/02 508/579 |
| 2008/0280791 | A1* | 11/2008 | Hewette | C10M 167/00 508/149 |
| 2013/0116460 | A1* | 5/2013 | Kanetani | C10M 107/34 554/213 |

FOREIGN PATENT DOCUMENTS

| | | | | |
|---|---|---|---|---|
| CN | 101696368 | | 4/2010 | |
| CN | 102295975 | | 12/2011 | |
| DE | 102011113158 | A1 * | 3/2013 | C10M 169/04 |
| JP | 59-38295 | | 3/1984 | |
| JP | 59-038295 | | 3/1984 | |
| JP | 63-017994 | | 1/1988 | |
| JP | 63-17994 | | 1/1988 | |
| JP | 64-036693 | | 2/1989 | |
| JP | 05-331481 | | 12/1993 | |
| JP | 5-331481 | | 12/1993 | |
| JP | 11-323373 | | 11/1999 | |
| JP | 2006-83378 | | 3/2006 | |
| JP | 2006-083378 | | 3/2006 | |
| JP | 2007-246684 | | 9/2007 | |

(Continued)

OTHER PUBLICATIONS

International Search Report dated Nov. 18, 2014 in corresponding (PCT) Application No. PCT/JP2014/071850.

(Continued)

*Primary Examiner* — Pamela H Weiss
(74) *Attorney, Agent, or Firm* — Wenderoth, Lind & Ponack, L.L.P.

(57) ABSTRACT

The present invention provides a water-soluble lubricating oil including a water-soluble base (A) and a corrosion inhibitor (B). The water-soluble base (A) contains at least one polyether (A1). A 0.1% by weight aqueous solution of the water-soluble lubricating oil has a surface tension of 31 mN/m or higher.

1 Claim, No Drawings

(56) References Cited

FOREIGN PATENT DOCUMENTS

| | | | | |
|---|---|---|---|---|
| JP | 2011-098437 | 5/2011 | | |
| JP | WO 2012008442 A1 * | 1/2012 | ..... | C10M 107/34 |
| JP | 2012-87297 | 5/2012 | | |
| JP | 2012-087297 | 5/2012 | | |
| WO | WO 2004053031 A2 * | 6/2004 | ..... | C10M 169/00 |

OTHER PUBLICATIONS

Japanese Society of Tribologists, Handbook of Lubrication, Yokendo, vol. 3, 1975, pp. 195-196.

* cited by examiner

WATER-SOLUBLE LUBRICANT OIL

TECHNICAL FIELD

The present invention relates to a water-soluble lubricating oil.

BACKGROUND ART

Mineral oils, polyolefins, and polyethers such as alkylene oxide adducts of alcohols have been used as lubricating base oils of operating oils, gear oils, bearing oils, or other oils. With the recent increase in environmental concerns, lubricating oils have been required to have biodegradability. The above hydrocarbon base oils and polyether base oils are still insufficient in biodegradability. Natural fats and oils such as vegetable oils and derivatives thereof and synthetic ester lubricating base oils have been used as biodegradable base oils (see Patent Literatures 1 and 2).

However, these natural fats and oils and synthetic ester lubricating base oils are easily hydrolyzed when mixed with water, thus exhibiting insufficient stability when lubricating oils are in use. Additionally, these base oils have low water solubility. Leakage of a lubricating oil containing such a low water soluble base oil causes severe environmental pollution due to oil droplets on the water surface. Such a lubricating oil is difficult to wash away or remove. In view of this, polyether base oils with high water solubility and high biodegradability have been used (see Patent Literature 3).

CITATION LIST

Patent Literature

Patent Literature 1: JP H05-323481 A
Patent Literature 2: JP H11-323373 A
Patent Literature 3: JP 2006-083378 A

SUMMARY OF INVENTION

Technical Problem

However, these lubricating oils contain many kinds of fatty acids and other compounds which have high toxicity in order to exhibit lubricity equal to that of conventional lubricating oils. With the recent increase in environmental concerns, the toxicity has become problematic.

An object of the present invention is to provide a lubricating oil that exhibits anti-corrosion properties and lubricity equal to those of conventional mineral oil-based lubricating oils, has a high water solubility, and is excellent in biodegradability and low toxicity.

Solution to Problem

As a result of intensive studies to solve the above problems, the present inventors arrived at the present invention. The present invention provides a water-soluble lubricating oil including a water-soluble base (A) and a corrosion inhibitor (B), the water-soluble base containing at least one polyether (A1), a 0.1% by weight aqueous solution of the water-soluble lubricating oil having a surface tension of 31 mN/m or higher.

Advantageous Effects of Invention

The water-soluble lubricating oil of present invention has the following effects.

(1) It has water-solubility and thus is easy to wash away and remove.
(2) It has low hydrolyzability and thus is stable.
(3) It has excellent biodegradability.
(4) It has low toxicity.
(5) It has lubricity and anti-corrosion properties equal to or higher than those of conventional mineral oil-based lubricating oils.
(6) It has little impact on the environment.
(7) It is less accumulative.

DESCRIPTION OF EMBODIMENTS

The water-soluble lubricating oil according to the present invention contains a water-soluble base (A) and a corrosion inhibitor (B). The water-soluble base (A) contains at least one polyether (A1). As used herein, the term "water-soluble" means having a solubility in water at 25° C. of 20 g or more per 100 g of water.

The water-soluble lubricating oil of the present invention preferably has a degree of biodegradation of 60% or more, more preferably 65% or more, still more preferably 70% or more.

The degree of biodegradation is measured in accordance with the OECD test method 301C. The test period is 28 days. If the degree of biodegradation is 60% or more, environmental pollution in the soil, river, sea, and the like in case of leakage of the lubricating oil can be prevented.

The polyether (A1) in the water-soluble lubricating oil of the present invention is not limited. The polyether (A1) is preferably an active hydrogen compound or an alkylene oxide adduct thereof, more preferably an alkylene oxide adduct of an active hydrogen compound. Examples of the active hydrogen compound include hydroxy group-containing compounds, amino group-containing compounds with a number average molecular weight of 10,000 or more, carboxy group-containing compounds, thiol group-containing compounds, and phosphoric acid compounds.

The active hydrogen compound or the alkylene oxide adduct thereof is preferably, for example, one or more selected from the group consisting of a polyether (A1-1) represented by Formula (1), a polyether (A1-2) represented by Formula (2), a polyether (A1-3) represented by Formula (3), and a water-soluble polyether thickener (A1-4).

$$R^1\text{—}[O\text{—}(A^1O)_j\text{—}R^2]_k \tag{1}$$

In Formula (1), $R^1$ is hydrogen or a hydrocarbon group having a valence of k and 1 to 12 carbon atoms; A1 is an alkylene group having 2 to 4 carbon atoms; $R^2$ is hydrogen or a hydrocarbon group having 1 to 8 carbon atoms; k is an integer of 1 to 6; and j is an integer that is 1 or greater and allows the polyether (A1-1) to have a number average molecular weight of 62 to 10,000.

$$(R^3COO)_qR^4\text{—}[(OA^2)_n\text{—}OH]_{4-q} \tag{2}$$

In Formula (2), $R^3$ is a hydrocarbon group that has 1 to 24 carbon atoms and may have one or more double bonds; $A^2$ is an alkylene group having 2 to 4 carbon atoms; $R^4$ is a residue of sorbitan from which at least one hydroxy group is removed; q is an integer of 1 to 3; and n is an integer that is 1 or greater and allows the polyether (A1-2) to have a number average molecular weight of 500 to 10,000.

$$HO—(A^3O)_m—[CO—R^5—COO(A^3O)_m]_p—H \quad (3)$$

In Formula (3), $R^5$ is a hydrocarbon group that has 2 to 36 carbon atoms, may have one or more double bonds, and may have one or more benzene rings; $A^3$ is an alkylene group having 2 to 4 carbon atoms; m is an integer of 1 to 100; and p is an integer of 1 to 10.

The polyether (A1-1) is represented by Formula (1).

$$R^1—[O—(A^1O)_j—R^2]_k \quad (1)$$

In Formula (1), $R^1$ is hydrogen or a hydrocarbon group having a valence of k and 1 to 12 carbon atoms; $A^1$ is an alkylene group having 2 to 4 carbon atoms; $R^2$ is hydrogen or a hydrocarbon group having 1 to 8 carbon atoms; k is an integer of 1 to 6; and j is an integer that is 1 or greater and allows the polyether (A1-1) to have a number average molecular weight of 62 to 10,000.

$A^1$ is an alkylene group having 2 to 4 carbon atoms. Examples of the alkylene group having 2 to 4 carbon atoms include an ethylene group, a 1,2- or 1,3-propylene group, and a 1,2-, 1,3-, or 1,4-butylene group.

In the formula, j is an integer that is 1 or greater and allows the polyether (A1-1) to have a number average molecular weight of 62 to 10,000. If j is 2 or greater, $A^1$s may be the same as or different from each other. If $A^1$s include two or more alkylene groups, $(A^1O)_j$ may be formed by block addition or random addition.

The polyether (A1-1) has a number average molecular weight of 62 to 10,000, preferably 62 to 8,000. The number average molecular weight can be measured by a known method, such as gel permeation chromatography.

Examples of the polyether (A1-1) include 1,2-propylene glycol, 1,3-propylene glycol, ethylene glycol, di-1,2-propylene glycol, diethylene glycol, triethylene glycol, polyethylene glycol, ethylene glycol monomethyl ether, ethylene glycol dimethyl ether, ethylene glycol methyl ethyl ether, polyethylene glycol dimethyl ether, ethylene oxide-propylene oxide block or random copolymers (degree of polymerization: 2 to 20), and adducts of alkylene oxides (hereinafter, simply "AOs") having 2 to 4 carbon atoms (e.g., ethylene oxide (hereinafter, simply "EO"), 1,2-propylene oxide (hereinafter, simply "PO"), 1,2-butylene oxide (hereinafter, simply "BO"), tetrahydrofuran (hereinafter, simply "THF")) with monovalent to hexavalent hydroxy group-containing compounds (e.g., methanol, ethanol, propanol, butanol, hexanol, heptanol, octanol, nonanol, decanol, undecanol, dodecanol, ethylene glycol, 1,2-propylene glycol, 1,3-propylene glycol, 1,4-butanediol, 1,6-hexylene glycol, glycerol, trimethylolpropane, pentaerythritol, sorbitol).

Preferred among these compounds are ethylene glycol, 1,2-propylene glycol, polyethylene glycol, methanol EO adducts, ethanol EO adducts, propanol EO adducts, butanol EO adducts, glycerol EO adducts, trimethylolpropane EO adducts, pentaerythritol EO adducts, sorbitol EO adducts, methanol EO/PO adducts, ethanol EO/PO adducts, propanol EO/PO adducts, butanol EO/PO adducts, 1,6-hexylene glycol EO/PO adducts, glycerol EO/PO adducts, trimethylolpropane EO/PO adducts, pentaerythritol EO/PO adducts, sorbitol EO/PO adducts, ethylene glycol EO/THF adducts, and sorbitol EO/THF adducts.

These polyethers (A1-1) may be used alone, or in combination of two or more thereof.

In the present invention, the number average molecular weight (hereinafter, simply "Mn") and the weight average molecular weight are measured by gel permeation chromatography at 40° C. using polyethylene oxide as a standard. One example of the measuring conditions is shown below.

Device body: HLC-8120 (available from Tosoh Corporation)

Column: TSKgel a6000, G3000 PWXL, available from Tosoh Corporation

Detector: differential refractometer built in the device body

Eluent: 0.5% sodium acetate.water/methanol (volume ratio 70/30)

Eluent flow rate: 1.0 mL/min

Column temperature: 40° C.

Sample: 0.25% eluent solution

Injection amount: 200 μL

Standard: TSK TANDARD POLYETHYLENE OXIDE, available from Tosoh Corporation

Data processing software: GPC-8020 model II (available from Tosoh Corporation)

The polyether (A1-2) is represented by Formula (2).

$$(R^3COO)_qR^4—[(OA^2)_n—OH]_{4-q} \quad (2)$$

In Formula (2), $R^3$ is a hydrocarbon group that has 1 to 24 carbon atoms and may have one or more double bonds; $A^2$ is an alkylene group having 2 to 4 carbon atoms; $R^4$ is a residue of sorbitan from which at least one hydroxy group is removed; q is an integer of 1 to 3; and n is an integer that is 1 or greater and allows the polyethers (A1-2) to have a number average molecular weight of 500 to 10,000.

$A^2$ is an alkylene group having 2 to 4 carbon atoms. Examples of the alkylene group having 2 to 4 carbon atoms include an ethylene group, a 1,2- or 1,3-propylene group, and a 1,2-, 1,3-, or 1,4-butylene group.

In the formula, n is an integer that is 1 or greater and allows the polyether (A1-2) to have a number average molecular weight of 500 to 10,000. If n is 2 or greater, $A^2$s may be the same as or different from each other. If $A^2$s include two or more alkylene groups, $(OA^2)_n$ may be formed by block addition or random addition.

Examples of the polyether (A1-2) include sorbitan mono- or di-fatty acid esters and alkylene oxide (e.g., EO, PO, BO, THF) adducts thereof. The sorbitan mono- or di-fatty acid esters include esters of sorbitan with saturated fatty acids (e.g., caplyric acid, lauric acid, myristic acid, palmitic acid, stearic acid) and/or unsaturated fatty acids (e.g., oleic acid, linoleic acid, linolenic acid). Preferred among these compounds are sorbitan monoester EO adducts and sorbitan monoester EO/PO adducts. The polyether (A1-2) has a number average molecular weight of 500 to 10,000, more preferably 750 to 5,000, still more preferably 1,000 to 4,000.

These polyethers (A1-2) may be used alone, or in combination of two or more thereof.

The polyether (A1-3) is represented by Formula (3).

$$HO—(A^3O)_m—[CO—R^5—COO(A^3O)_m]_p—H \quad (3)$$

In Formula (3), $R^5$ is a hydrocarbon group that has 2 to 36 carbon atoms, may have one or more double bonds, and may have one or more benzene rings; $A^3$ is an alkylene group having 2 to 4 carbon atoms; m is an integer of 1 to 100; and p is an integer of 1 to 10.

$A^3$ is an alkylene group having 2 to 4 carbon atoms. Examples of the alkylene group having 2 to 4 carbon atoms include an ethylene group, a 1,2- or 1,3-propylene group, and a 1,2-, 1,3-, or 1,4-butylene group.

In the formula, m is an integer of 1 to 100. If m is 2 or greater, $A^3$s may be the same as or different from each other. If $A^3$s include two or more alkylene groups, $(A^3O)_m$ may be formed by block addition or random addition.

Examples of the polyether (A1-3) include esters of glycols with dibasic acids.

Examples of the glycols include ethylene glycol, 1,2-propylene glycol, polyethylene glycol, polypropylene glycol, EO block copolymers of propylene glycol, PO block copolymers of ethylene glycol, 1,4-butanediol EO adducts, 1,4-butanediol EO/PO adducts, 1,4-butanediol EO/BO adducts, 1,4-butanediol EO/THF adducts, 1,6-hexylene glycol EO adducts, 1,6-hexylene glycol EO/PO adducts, 1,6-hexylene glycol EO/BO adducts, and 1,6-hexylene glycol EO/THF adducts. Preferred among these compounds are 1,2-propylene glycol, polyethylene glycol, polypropylene glycol, EO block copolymers of propylene glycol, and PO block copolymers of ethylene glycol. The glycols may be used alone, or in combination of two or more thereof.

Examples of the dibasic acids include alkanedicarboxylic acids having 4 to 36 carbon atoms, alkenedicarboxylic acids having 4 to 36 carbon atoms, aromatic dicarboxylic acids having 8 to 36 carbon atoms, and alicyclic dicarboxylic acids having 6 to 40 carbon atoms. Preferred among these acids are alkanedicarboxylic acids having 4 to 20 carbon atoms, alkenedicarboxylic acids having 4 to 20 carbon atoms, and aromatic dicarboxylic acids having 8 to 20 carbon atoms. More preferred are succinic acid, adipic acid, sebacic acid, maleic acid, fumaric acid, phthalic acid, isophthalic acid, and terephthalic acid. The dibasic acids may be used alone, or in combination of two or more thereof.

Examples of the esters of glycols with dibasic acids include esters of polyethylene glycol with adipic acid, esters of EO block copolymers of propylene glycol with fumaric acid, esters of polyethylene glycol and 1,2-propylene glycol with succinic acid, esters of polyethylene glycol and polypropylene glycol with sebacic acid and isophthalic acid, and esters of PO block copolymers of ethylene glycol with adipic acid and terephthalic acid.

The water-soluble polyether thickener (A1-4) is a water-soluble polyether thickener other than the polyether (A1-1). Examples thereof include alkylene oxide adducts of polyalcohols, AO adducts of polyamines, and polycarboxylic acid (salts). Among these thickeners, AO adducts of polyalcohols and AO adducts of polyamines are preferred. The thickeners (A1-4) may be used alone, or in combination of two or more thereof.

The thickener (A1-4) preferably has a Mn of 10,000 or more, more preferably 10,000 to 500,000, still more preferably 15,000 to 200,000. If the Mn is 10,000 or more, the lubricity is even better.

The polyalcohols constituting the AO adducts of polyalcohols are divalent or higher valent polyols. Examples thereof include ethylene glycol, 1,2-propylene glycol, 1,3-propylene glycol, 1,6-hexylene glycol, glycerol, trimethylolpropane, pentaerythritol, sorbitan, and sorbitol.

Examples of the polyamines constituting the AO adducts of polyamines include (poly)alkylenepolyamines (e.g., ethylenediamine, diethylenetriamine, tetraethylenepentamine, pentaethylenehexamine) and polyamide polyamines.

Example of the polyamide polyamines include polyamide polyamines with a weight average molecular weight of 600 to 6,000 obtained by condensation of the above (poly) alkylenepolyamines with dimer acids or dibasic acids. Here, the dimer acids can be obtained by polymerizing oleic acid or linoleic acid, and the dibasic acids include sebacic acid and adipic acid.

Examples of the AO include alkylene oxides having 2 to 4 carbon atoms, such as EO, PO, BO, and THF. If two or more AOs are used in combination, the AOs may be formed by block addition, random addition, or a combination thereof.

Preferred thickeners (A1-4) include 1,6-hexylene glycol EO/PO adducts, EO/PO adducts of polyamide polyamines composed of a dimer acid of linoleic acid and pentaethylenehexamine, and glycerol EO/PO adducts.

The thickeners (A1-4) may be used alone, or in combination of two or more thereof.

In the water-soluble lubricating oil of the present invention, the water-soluble base (A) may contain one or more selected from the group consisting of cellulose derivatives (A2), starch (A3), and polyvinyl alcohols (A4).

Examples of the cellulose derivatives (A2) include carboxymethyl cellulose, acetyl cellulose, phosphoric acid cellulose, ethyl cellulose, and oxyethyl cellulose.

The starch (A3) may be any starch. It may be starch derived from potato, wheat, or corn.

Examples of the polyvinyl alcohols (A4) include polyvinyl alcohols with a degree of polymerization of 300 to 3,000.

Examples of the corrosion inhibitor (B) in the water-soluble lubricating oil of the present invention include alkanolamines (e.g., monoethanolamine, diethanolamine, triethanolamine, monoisopropanolamine, diisopropanolamine, triisopropanolamine), alkylamines with an alkyl group having 1 to 24 carbon atoms, EO (1 to 20 mol) adducts of alkylamines with an alkyl group having 1 to 24 carbon atoms, EO (1 to 20 mol) adducts of cyclic amines composed of 6 to 24 carbon atoms, amines containing two or more nitrogen atoms (e.g., ethylenediamine, diethylenetriamine, triethylenetetramine, tetraethylenepentamine) and EO (1 to 60 mol) adducts thereof, and alkenyl succinic acids. From the viewpoint of low toxicity, alkanolamines are preferred, and diethanolamines, triethanolamines, and the like are more preferred.

With respect to the water-soluble lubricating oil of the present invention, the surface tension is measured by a pendant-drop method using a 0.1% by weight aqueous solution of the water-soluble lubricating oil. The measurement conditions are listed below.

Device body: automatic contact angle meter DM700 (available from Kyowa Interface Science Co., Ltd.)

Measurement solution: 0.1% by weight aqueous solution of the water-soluble lubricating oil prepared by, at room temperature, weighing 0.10 g of the water-soluble lubricating oil in a 200-mL beaker, adding 99.90 g of dilution water, and stirring the mixture with stirrer bars for 15 minutes Measurement temperature: 27° C.

Dilution water: ion-exchanged water with an electrical conductivity of 0.2 ρS/cm or less Needle tip material: Teflon (registered trademark)-coated needle 18 G (available from Kyowa Interface Science Co., Ltd.)

Pendant drop amount: 8 μL

Measured value: The surface tension is measured over time every 10 seconds from immediately after a drop is suspended, and the value when the change in the surface tension in 10 seconds reaches less than 0.1 mN/m is taken as the surface tension.

A 0.1% by weight aqueous solution of the water-soluble lubricating oil of the present invention has a surface tension of 31 mN/m or higher, preferably 35 mN/m or higher, more preferably 40 mN/m or higher. If the surface tension is less than 31 mN/m, the toxicity is high.

For the 0.1% by weight aqueous solution of the water-soluble lubricating oil of the present invention to have a surface tension of 31 mN/m or higher, the water-soluble base (A) is preferably the polyether (A1), and the corrosion inhibitor (B) is preferably any of the corrosion inhibitors listed above.

The water-soluble lubricating oil of the present invention preferably further contains an antioxidant (C) from the viewpoint of its impact on the environment (long life).

Examples of the antioxidant (C) include phenolic antioxidants, such as 2,4-dimethyl-6-tert-butyl phenol and 4,4'-butylidene bis(6-tert-butyl metacresol); amine antioxidants, such as N-phenyl-4-octylphenylamine and bis(4-octylphenyl)amine; zinc dihydrocarbyl dithiophosphate with a carbyl group having 1 to 36 carbon atoms and zinc diallyl thiophosphate.

In the present invention, the amount of the water-soluble base (A) is preferably 88.0 to 98.9% by weight, more preferably 90.0 to 97.8% by weight, still more preferably 91.3 to 95.7% by weight based on the total weight of the components (A), (B), and (C), from the viewpoint of the lubricity and the biodegradation.

The amount of the corrosion inhibitor (B) is preferably 1.0 to 10.0% by weight, more preferably 2.0 to 9.0% by weight, still more preferably 4.0 to 8.0% by weight based on the total weight of the components (A), (B), and (C), from the viewpoint of the anti-corrosion properties and low toxicity.

The amount of the antioxidant (C) is preferably 0.1 to 2.0% by weight, more preferably 0.2 to 1.0% by weight, still more preferably 0.3 to 0.7% by weight based on the total weight of the components (A), (B), and (C), from the viewpoint of the lubricity and the impact on the environment.

The water-soluble lubricating oil of the present invention preferably has a kinetic viscosity at 40° C. of 30 to 200 $mm^2/s$, more preferably 40 to 150 $mm^2/s$, from the viewpoint of the lubricity.

The kinetic viscosity of the water-soluble lubricating oil is measured in accordance with JIS K 2283:2000 (Crude petroleum and petroleum products—Determination of kinematic viscosity and calculation of viscosity index from kinematic viscosity) with an Ubbelohde viscometer.

If necessary, the water-soluble lubricating oil of the present invention may appropriately contain one or more selected from the group consisting of a water-insoluble polyether (D), a defoamant, and a pH adjuster. In the present invention, the term "water-insoluble" means having a solubility in water at 25° C. of less than 20 g per 100 g of water.

Examples of the water-insoluble polyether (D) include polypropylene glycol, polypropylene glycol monoalkyl ethers, and 1,4-butanediol EO/THF (mole ratio: 80/20, number average molecular weight: 2,000) adducts.

Examples of the defoamant include silicone defoamants.

Examples of the pH adjuster include organic acids (e.g., formic acid, acetic acid, lactic acid, malic acid, citric acid, tartaric acid), inorganic acids (e.g., hydrochloric acid, phosphoric acid, sulfuric acid), and alkali metal hydroxides (e.g., lithium hydroxide, sodium hydroxide, potassium hydroxide).

In the water-soluble lubricating oil of the present invention, the amounts of the pH adjuster and the defoamant are preferably each 10% by weight or less, more preferably 5% by weight or less based on the total weight of the water-soluble lubricating oil.

The water-soluble lubricating oil of the present invention preferably has a water content of 10% by weight or less, more preferably 5% by weight or less based on the total weight of the water-soluble lubricating oil, from the viewpoint of the anti-corrosion properties and the lubricity.

The water-soluble lubricating oil of the present invention preferably has a fish toxicity of 500 mg/L or more, more preferably 1,000 mg/L or more, still more preferably 2,000 mg/L or more.

The fish toxicity of the water-soluble lubricating oil is determined from LC50 obtained by a test in accordance with the OECD method 203 at a test period of 96 hours.

The water-soluble lubricating oil of the present invention can be usually obtained by stirring and mixing the water-soluble base (A), the corrosion inhibitor (B) and other materials at 40° C. to 60° C. for one to four hours and optionally adjusting the pH using a pH adjuster (e.g., caustic soda (NaOH), caustic potash (KOH)). The pH of the water-soluble lubricating oil can be determined by measuring, with a pH meter "M-12" (available from Horiba, Ltd.), the pH of an aqueous solution prepared by diluting the water-soluble lubricating oil two-fold with ion-exchanged water.

The pH of the water-soluble lubricating oil is preferably within the range of 6 to 12, more preferably 7 to 11, from the viewpoint of the anti-corrosion properties.

The water-soluble lubricating oil of the present invention can be preferably used as a bearing oil for ships, an operating oil for ships, or a gear oil for ships.

EXAMPLES

The present invention will be further described with reference to the examples below. The present invention is not limited to these examples. The "part(s)" hereinafter refers to part(s) by weight.

Examples 1 to 30, Comparative Examples 1 to 10

The materials in the amounts (parts) listed in Tables 1 to 3 were stirred and mixed at a temperature that was within the range of 50° C. to 60° C. and suitable for the respective examples and comparative examples. Thus, water-soluble lubricating oils (S1) to (S30) according to the present invention and comparative water-soluble lubricating oils (H1) to (H10) were obtained each in an amount of 1,000 parts.

Tables 1 to 3 show the kinetic viscosity ($mm^2/s$) at 40° C. of these lubricating oils and the surface tension of 0.1% by weight aqueous solutions of these lubricating oils. The kinetic viscosity was measured under the following conditions.

<Measurement Method of Kinetic Viscosity>

Device: automatic viscometer (model VMC-252), available from Rigo Co., Ltd.

Viscometer: Ubbelohde viscometer (viscometer number 2)

Measurement temperature: 40° C.

The abbreviations in Tables 1 to 3 represent the following compositions.

(A1-1-1) PEG-200 (available from Sanyo Chemical Industries, Ltd.): polyethylene glycol (number average molecular weight=200)

(A1-1-2) PEG-300 (available from Sanyo Chemical Industries, Ltd.): polyethylene glycol (number average molecular weight=300)

(A1-1-3) PEG-1000 (available from Sanyo Chemical Industries, Ltd.): polyethylene glycol (number average molecular weight=1,000)

(A1-1-4) methanol EO adduct (number average molecular weight=500)

(A1-1-5) propanol EO/PO adduct (number average molecular weight=1,000, mole ratio EO/PO=79/21)

(A1-1-6) butanol EO/PO adduct (number average molecular weight=1,500, mole ratio EO/PO=79/21)

(A1-1-7) butanol EO/PO adduct (number average molecular weight=4,000, mole ratio EO/PO=56/44)

(A1-1-8) glycerol EO adduct (number average molecular weight=500)

(A1-1-9) glycerol EO/PO adduct (number average molecular weight=2,000, mole ratio EO/PO=79/21)

(A1-1-10) trimethylolpropane EO/PO adduct (number average molecular weight=1,000, mole ratio EO/PO=56/44)

(A1-1-11) pentaerythritol EO/PO adduct (number average molecular weight=5,000, mole ratio EO/PO=79/21)

(A1-1-12) sorbitol EO/PO adduct (number average molecular weight=1,500, mole ratio EO/PO=79/21)

(A1-1-13) sorbitol EO/PO adduct (number average molecular weight=6,000, mole ratio EO/PO=56/44)

(A1-1-14) PG: 1,2-propylene glycol (A1-1-15) EG-M: ethylene glycol monomethyl ether (A1-1-16) EG-EO/THF: ethylene glycol EO/THF adduct (number average molecular weight=5,000, mole ratio EO/THF=80/20)

(A1-1-17) sorbitol EO/THF adduct (number average molecular weight=9,000, mole ratio EO/THF=80/20)

(A1-1-18) sorbitol EO adduct (number average molecular weight=2,000)

(A1-1-19) polyethylene glycol dimethyl ether: PEG-300 (available from Sanyo Chemical Industries, Ltd.) in which both terminals are methyl-etherified (number average molecular weight=500)

(A1-1-20) 1,6-hexylene glycol EO/PO adduct (number average molecular weight=18,000, mole ratio EO/PO=75/25)

(A1-2-1) sorbitan mono-fatty acid ester EO adduct: IONET S20 (available from Sanyo Chemical Industries, Ltd., sorbitan mono-fatty acid ester) EO adduct (number average molecular weight=1,300, number of carbon atoms in fatty acid=6 to 18))

(A1-2-2) sorbitan mono-fatty acid ester EO/PO adduct: IONET S80 (available from Sanyo Chemical Industries, Ltd., sorbitan mono-fatty acid ester) EO/PO adduct (number average molecular weight=4,000, mole ratio EO/PO=65/35, carbon number of fatty acid=14 to 22)

(A1-3-1) polyetherpolyester: ester (number average molecular weight=1,000, mole ratio PEG/adipic acid=61/39) of PEG-300 (available from Sanyo Chemical Industries, Ltd.) with adipic acid (A1-3-2) polyetherpolyester: ester (number average molecular weight=8,000, mole ratio PEG/PG/adipic acid=2/49/49) of PEG-300 (available from Sanyo Chemical Industries, Ltd.) and PG with succinic acid (A1-3-3) polyetherpolyester: ester (number average molecular weight=24,300, mole ratio PE-68/adipic acid/terephthalic acid=60/20/20) of PE-68 (available from Sanyo Chemical Industries, Ltd, propylene glycol EO block copolymer) with adipic acid and terephthalic acid (A1-4-1) polyamidepolyamine EO/PO adduct: EO/PO adduct (number average molecular weight=190,000, mole ratio EO/PO=80/20) of polyamide polyamine (weight average molecular weight 1, 900) of a dimer acid of linoleic acid (HARIDIMER 216, available from Harima Chemicals Group, Inc.) with pentaethylenehexamine (A-2) carboxymethyl cellulose (number average molecular weight=90,000)

(A-3) starch (derived from corn)

(A-4) polyvinyl alcohol (degree of polymerization=about 500)

(B-1) triethanolamine (B-2) diethanolamine (B-3) cyclohexylamine EO adduct (number of moles of EO added=2)

(B-4) DSA: dodecenylsuccinic acid (C-1) phenolic antioxidant: 4,4'-butylidene bis(6-tert-butyl metacresol)

(C-2) amine antioxidant: N-phenyl-4-octylphenylamine (D-1) 1,4-butanediol EO/THF adduct (number average molecular weight=2,000, mole ratio EO/THF=40/60)

(D-2) PPG-1,000: SANNIX PP-1,000 (available from Sanyo Chemical Industries, Ltd., polyoxypropylene glycol) (number average molecular weight=1,000)

The above compounds (A1-1-4) to (A1-1-13), (A1-1-16) to (A1-1-18), (A1-1-20), (A1-2-1), (A1-2-2), (B-3), and (D-1) were prepared by alkylene oxide addition reaction with the aid of potassium hydroxide as a catalyst using a pressure reactor. The reaction was performed at a suitable temperature within the range of 100° C. to 150° C. for a suitable period of time within the range of 4 to 20 hours. The compound (A1-1-19) was prepared by reacting a methanol EO adduct with methyl chloride with the aid of potassium hydroxide as a catalyst using a pressure reactor, and water washing the reaction product. The reaction was performed at 50° C. for eight hours. The compounds (A1-3-1) to (A1-3-3) were prepared by dehydration condensation of glycol and a dibasic acid with the aid of a titanium-containing catalyst (disclosed in JP 2006-243715 A) using an evacuable reactor. The reaction was performed at a suitable temperature within the range of 180° C. to 230° C. for a suitable period of time within the range of one to eight hours. The compounds (A1-4-1) was prepared as follows: HARIDIMER 216 (Harima Chemicals Group, Inc.) and pentaethylenehexamine were subjected to dehydration condensation under reduced pressure at 150° C. for seven hours to prepare polyamide polyamine; the polyamide polyamine was subjected to addition reaction with a mixture of ethylene oxide and propylene oxide with the aid of potassium hydroxide as a catalyst at 120° C. for 10 hours using a pressure reactor. The other compounds were commercial products.

TABLE 1

| | | | | | Example | | | | | |
|---|---|---|---|---|---|---|---|---|---|---|
| | | | | Molecular weight | 1 S1 | 2 S2 | 3 S3 | 4 S4 | 5 S5 | 6 S6 |
| Material | Water-soluble base (A) | Polyether (A1) | PEG-200 (A1-1-1) | 200 | — | 860 | — | — | 600 | — |
| | | | PEG-300 (A1-1-2) | 300 | 800 | — | — | 970 | — | 850 |
| | | | PEG-1000 (A1-1-3) | 1000 | — | — | — | — | — | — |
| | | | Methanol EO adduct (A1-1-4) | 500 | — | — | — | — | — | — |
| | | | Propanol EO/PO adduct (A1-1-5) | 1000 | — | — | — | — | — | — |
| | | | Butanol EO/PO adduct (A1-1-6) | 1500 | — | — | — | — | — | — |

TABLE 1-continued

| | | | | | | | | | |
|---|---|---|---|---|---|---|---|---|---|
| | | Butanol EO/PO adduct (A1-1-7) | 4000 | — | — | — | — | — | — |
| | | Glycerol EO adduct (A1-1-8) | 500 | — | — | — | — | — | — |
| | | Glycerol EO/PO adduct (A1-1-9) | 2000 | — | — | — | — | — | — |
| | | Trimethylolpropane EO/PO adduct (A1-1-10) | 1000 | — | — | — | — | — | — |
| | | Pentaerythritol EO/PO adduct (A1-1-11) | 5000 | — | — | — | — | — | — |
| | | Sorbitol EO/PO adduct (A1-1-12) | 1500 | — | — | — | — | — | — |
| | | Sorbitol EO/PO adduct (A1-1-13) | 6000 | — | — | — | — | — | — |
| | | PG (A1-1-14) | 76 | — | — | 760 | — | — | — |
| | | EG-M (A1-1-15) | 76 | — | — | — | — | — | — |
| | | EG-EO/THF (A1-1-16) | 5000 | — | — | 120 | — | 100 | 30 |
| | | Sorbitol EO/THF adduct (A1-1-17) | 9000 | — | 40 | — | 10 | — | — |
| | | Sorbitol EO adduct (A1-1-18) | 2000 | — | — | — | — | — | — |
| | | Polyethylene glycol dimethyl ether (A1-1-19) | 500 | — | — | — | — | — | — |
| | | Sorbitan mono-fatty acid ester EO adduct (A1-2-1) | 1300 | 45 | — | — | — | 100 | — |
| | | Sorbitan mono-fatty acid ester EO/PO adduct (A1-2-2) | 4000 | — | 50 | 80 | — | — | 20 |
| | | Polyetherpolyester (A1-3-1) | 1000 | — | — | — | — | — | — |
| | | Polyetherpolyester (A1-3-2) | 8000 | — | — | — | — | — | — |
| | | Polyetherpolyester (A1-3-3) | 24300 | — | — | — | — | — | — |
| | | Polyamide polyamine EO/PO adduct (A1-4-1) | 190000 | 55 | 30 | 20 | 9 | 100 | 20 |
| | Cellulose derivative (A2) | Carboxymethyl cellulose (A-2) | 90000 | — | — | — | — | — | — |
| | Starch (A3) | Starch (derived from corn) (A-3) | — | — | — | — | — | — | — |
| | Polyvinyl alcohol (A4) | Polyvinyl alcohol (A-4) | — | — | — | — | — | — | — |
| Corrosion inhibitor (B) | | Triethanolamine (B-1) | — | — | — | — | — | 100 | — |
| | | Diethanolamine (B-2) | — | — | 20 | — | — | — | 80 |
| | | Cyclohexylamine EO adduct (B-3) | — | — | — | 20 | 10 | — | — |
| Antioxidant (C) | | Phenolic antioxidant (C-1) | — | — | — | — | — | — | — |
| | | Amine antioxidant (C-2) | — | — | — | — | 1 | — | — |
| Water-insoluble polyether (D) | | 1,4-Butanediol EO/THF adduct (D-1) | 2000 | 50 | — | — | — | — | — |
| Total | | | | 1000 | 1000 | 1000 | 1000 | 1000 | 1000 |
| Physical properties | | Surface tention (mN/m) | | 41 | 50 | 47 | 54 | 51 | 52 |
| | | Kinetic viscosity ($mm^2/s$) | | 86 | 81 | 77 | 48 | 120 | 76 |
| Property evaluation | | Biodegradability | | Good | Good | Good | Good | Good | Good |
| | | Lubricity (friction coefficient) | | 0.05 | 0.09 | 0.07 | 0.11 | 0.09 | 0.11 |
| | | Anti-corrosion properties | | Good | Good | Good | Good | Good | Good |
| | | Toxicity | | Good | Good | Good | Good | Good | Good |

| | | | | | Example | | | | |
|---|---|---|---|---|---|---|---|---|---|
| | | | | Molecular weight | 7 S7 | 8 S8 | 9 S9 | 10 S10 | 11 S11 |
| Material | Water-soluble base (A) | Polyether (A1) | PEG-200 (A1-1-1) | 200 | 960 | 760 | — | — | — |
| | | | PEG-300 (A1-1-2) | 300 | — | — | 806 | 806 | 800 |
| | | | PEG-1000 (A1-1-3) | 1000 | — | — | — | — | — |
| | | | Methanol EO adduct (A1-1-4) | 500 | — | — | — | — | — |
| | | | Propanol EO/PO adduct (A1-1-5) | 1000 | — | — | — | — | — |
| | | | Butanol EO/PO adduct (A1-1-6) | 1500 | — | — | — | — | — |
| | | | Butanol EO/PO adduct (A1-1-7) | 4000 | — | — | — | — | — |
| | | | Glycerol EO adduct (A1-1-8) | 500 | — | — | — | — | — |
| | | | Glycerol EO/PO adduct (A1-1-9) | 2000 | — | — | — | — | — |
| | | | Trimethylolpropane EO/PO adduct (A1-1-10) | 1000 | — | — | — | — | — |
| | | | Pentaerythritol EO/PO adduct (A1-1-11) | 5000 | — | — | — | — | — |
| | | | Sorbitol EO/PO adduct (A1-1-12) | 1500 | — | — | — | — | — |
| | | | Sorbitol EO/PO adduct (A1-1-13) | 6000 | — | — | — | — | — |
| | | | PG (A1-1-14) | 76 | — | — | — | — | — |
| | | | EG-M (A1-1-15) | 76 | — | — | — | — | — |
| | | | EG-EO/THF (A1-1-16) | 5000 | — | 120 | — | — | — |
| | | | Sorbitol EO/THF adduct (A1-1-17) | 9000 | 20 | — | — | — | — |
| | | | Sorbitol EO adduct (A1-1-18) | 2000 | — | — | — | — | — |
| | | | Polyethylene glycol dimethyl ether (A1-1-19) | 500 | — | — | — | — | — |
| | | | Sorbitan mono-fatty acid ester EO adduct (A1-2-1) | 1300 | — | — | 43 | 43 | 45 |
| | | | Sorbitan mono-fatty acid ester EO/PO adduct (A1-2-2) | 4000 | — | 80 | — | — | — |
| | | | Polyetherpolyester (A1-3-1) | 1000 | — | — | — | — | — |
| | | | Polyetherpolyester (A1-3-2) | 8000 | — | — | — | — | — |
| | | | Polyetherpolyester (A1-3-3) | 24300 | — | — | — | — | — |

TABLE 1-continued

| | | | | | | | | |
|---|---|---|---|---|---|---|---|---|
| | | Polyamide polyamine EO/PO adduct (A1-4-1) | 190000 | — | — | 56 | 56 | — |
| | Cellulose derivative (A2) | Carboxymethyl cellulose (A-2) | 90000 | 10 | — | — | — | — |
| | Starch (A3) | Starch (derived from corn) (A-3) | — | — | — | — | — | — |
| | Polyvinyl alcohol (A4) | Polyvinyl alcohol (A-4) | — | — | — | — | — | 55 |
| Corrosion inhibitor (B) | | Triethanolamine (B-1) | — | — | — | 45 | 45 | 50 |
| | | Diethanolamine (B-2) | — | — | — | — | — | — |
| | | Cyclohexylamine EO adduct (B-3) | — | 10 | 40 | — | — | — |
| Antioxidant (C) | | Phenolic antioxidant (C-1) | — | — | — | 5 | — | — |
| | | Amine antioxidant (C-2) | — | — | — | — | 5 | — |
| Water-insoluble polyether (D) | | 1,4-Butanediol EO/THF adduct (D-1) | 2000 | — | — | 45 | 45 | 50 |
| Total | | | | 1000 | 1000 | 1000 | 1000 | 1000 |
| Physical properties | | Surface tention (mN/m) | | 52 | 50 | 41 | 41 | 43 |
| | | Kinetic viscosity ($mm^2/s$) | | 45 | 40 | 86 | 86 | 82 |
| Property evaluation | | Biodegradability | | Good | Good | Good | Good | Good |
| | | Lubricity (friction coefficient) | | 0.08 | 0.12 | 0.10 | 0.10 | 0.10 |
| | | Anti-corrosion properties | | Good | Good | Good | Good | Good |
| | | Toxicity | | Good | Good | Good | Good | Good |

| | | | | | Example | | | | |
|---|---|---|---|---|---|---|---|---|---|
| | | | | Molecular weight | 12 S12 | 13 S13 | 14 S14 | 15 S15 | 16 S16 |
| Material | Water-soluble base (A) | Polyether (A1) | PEG-200 (A1-1-1) | 200 | — | — | — | — | — |
| | | | PEG-300 (A1-1-2) | 300 | 800 | — | — | — | 940 |
| | | | PEG-1000 (A1-1-3) | 1000 | — | 770 | — | — | — |
| | | | Methanol EO adduct (A1-1-4) | 500 | — | — | 950 | — | — |
| | | | Propanol EO/PO adduct (A1-1-5) | 1000 | — | — | — | — | — |
| | | | Butanol EO/PO adduct (A1-1-6) | 1500 | — | — | — | — | — |
| | | | Butanol EO/PO adduct (A1-1-7) | 4000 | — | — | — | — | — |
| | | | Glycerol EO adduct (A1-1-8) | 500 | — | — | — | — | — |
| | | | Glycerol EO/PO adduct (A1-1-9) | 2000 | — | — | — | — | — |
| | | | Trimethylolpropane EO/PO adduct (A1-1-10) | 1000 | — | — | — | — | — |
| | | | Pentaerythritol EO/PO adduct (A1-1-11) | 5000 | — | — | — | — | — |
| | | | Sorbitol EO/PO adduct (A1-1-12) | 1500 | — | — | — | — | — |
| | | | Sorbitol EO/PO adduct (A1-1-13) | 6000 | — | — | — | — | — |
| | | | PG (A1-1-14) | 76 | — | — | — | — | — |
| | | | EG-M (A1-1-15) | 76 | — | — | — | 600 | — |
| | | | EG-EO/THF (A1-1-16) | 5000 | — | — | — | 200 | — |
| | | | Sorbitol EO/THF adduct (A1-1-17) | 9000 | — | 100 | — | — | — |
| | | | Sorbitol EO adduct (A1-1-18) | 2000 | — | — | — | — | — |
| | | | Polyethylene glycol dimethyl ether (A1-1-19) | 500 | — | — | — | — | — |
| | | | Sorbitan mono-fatty acid ester EO adduct (A1-2-1) | 1300 | 45 | — | — | — | 30 |
| | | | Sorbitan mono-fatty acid ester EO/PO adduct (A1-2-2) | 4000 | — | 80 | — | 150 | — |
| | | | Polyetherpolyester (A1-3-1) | 1000 | — | — | — | — | — |
| | | | Polyetherpolyester (A1-3-2) | 8000 | — | — | — | — | — |
| | | | Polyetherpolyester (A1-3-3) | 24300 | — | — | — | — | — |
| | | | Polyamide polyamine EO/PO adduct (A1-4-1) | 190000 | 50 | — | — | — | — |
| | | Cellulose derivative (A2) | Carboxymethyl cellulose (A-2) | 90000 | — | — | — | — | — |
| | | Starch (A3) | Starch (derived from corn) (A-3) | — | 5 | — | — | — | — |
| | | Polyvinyl alcohol (A4) | Polyvinyl alcohol (A-4) | — | — | — | — | — | — |
| | Corrosion inhibitor (B) | | Triethanolamine (B-1) | — | 50 | 50 | 45 | 50 | 30 |
| | | | Diethanolamine (B-2) | — | — | — | — | — | — |
| | | | Cyclohexylamine EO adduct (B-3) | — | — | — | — | — | — |
| | Antioxidant (C) | | Phenolic antioxidant (C-1) | — | — | — | 5 | — | — |
| | | | Amine antioxidant (C-2) | — | — | — | — | — | — |
| | Water-insoluble polyether (D) | | 1,4-Butanediol EO/THF adduct (D-1) | 2000 | 50 | — | — | — | — |
| Total | | | | | 1000 | 1000 | 1000 | 1000 | 1000 |
| Physical properties | | | Surface tention (mN/m) | | 43 | 50 | 55 | 48 | 54 |
| | | | Kinetic viscosity ($mm^2/s$) | | 86 | 140 | 54 | 43 | 48 |
| Property evaluation | | | Biodegradability | | Good | Good | Good | Good | Good |
| | | | Lubricity (friction coefficient) | | 0.10 | 0.13 | 0.11 | 0.12 | 0.12 |
| | | | Anti-corrosion properties | | Good | Good | Good | Good | Good |
| | | | Toxicity | | Good | Good | Good | Good | Good |

TABLE 2

| | | | | Molecular weight | Example 17 S17 | 18 S18 | 19 S19 | 20 S20 | 21 S21 | 22 S22 | 23 S23 |
|---|---|---|---|---|---|---|---|---|---|---|---|
| Material | Water-soluble base (A) | Polyether (A1) | PEG-200 (A1-1-1) | 200 | — | — | — | — | — | — | — |
| | | | PEG-300 (A1-1-2) | 300 | — | — | — | — | — | — | — |
| | | | PEG-1000 (A1-1-3) | 1000 | — | — | — | — | — | — | — |
| | | | Methanol EO adduct (A1-1-4) | 500 | — | — | — | — | — | — | 500 |
| | | | Propanol EO/PO adduct (A1-1-5) | 1000 | 950 | — | — | — | — | — | — |
| | | | Butanol EO/PO adduct (A1-1-6) | 1500 | — | 950 | — | — | — | — | — |
| | | | Butanol EO/PO adduct (A1-1-7) | 4000 | — | — | — | — | — | — | 450 |
| | | | Glycerol EO adduct (A1-1-8) | 500 | — | — | — | — | — | — | — |
| | | | Glycerol EO/PO adduct (A1-1-9) | 2000 | — | — | 950 | — | — | — | — |
| | | | Trimethylolpropane EO/PO adduct (A1-1-10) | 1000 | — | — | — | 950 | — | — | — |
| | | | Pentaerythritol EO/PO adduct (A1-1-11) | 5000 | — | — | — | — | — | — | — |
| | | | Sorbitol EO/PO adduct (A1-1-12) | 1500 | — | — | — | — | 950 | — | — |
| | | | Sorbitol EO/PO adduct (A1-1-13) | 6000 | — | — | — | — | — | 950 | — |
| | | | PG (A1-1-14) | 76 | — | — | — | — | — | — | — |
| | | | EG-M (A1-1-15) | 76 | — | — | — | — | — | — | — |
| | | | EG-EO/THF (A1-1-16) | 5000 | — | — | — | — | — | — | — |
| | | | Sorbitol EO/THF adduct (A1-1-17) | 9000 | — | — | — | — | — | — | — |
| | | | Sorbitol EO adduct (A1-1-18) | 2000 | — | — | — | — | — | — | — |
| | | | Polyethylene glycol dimethyl ether (A1-1-19) | 500 | — | — | — | — | — | — | — |
| | | | Sorbitan mono-fatty acid ester EO adduct (A1-2-1) | 1300 | — | — | — | — | — | — | — |
| | | | Sorbitan mono-fatty acid ester EO/PO adduct (A1-2-2) | 4000 | — | — | — | — | — | — | — |
| | | | Polyetherpolyester (A1-3-1) | 1000 | — | — | — | — | — | — | — |
| | | | Polyetherpolyester (A1-3-2) | 8000 | — | — | — | — | — | — | — |
| | | | Polyetherpolyester (A1-3-3) | 24300 | — | — | — | — | — | — | — |
| | | | Polyamide polyamine EO/PO adduct (A1-4-1) | 190000 | — | — | — | — | — | — | — |
| | | Cellulose derivative (A2) | Carboxymethyl cellulose (A-2) | 90000 | — | — | — | — | — | — | — |
| | | Starch (A3) | Starch (derived from corn) (A-3) | — | — | — | — | — | — | — | — |
| | | Polyvinyl alcohol (A4) | Polyvinyl alcohol (A-4) | — | — | — | — | — | — | — | — |
| | Corrosion inhibitor (B) | | Triethanolamine (B-1) | — | 45 | 45 | 45 | 45 | 45 | 45 | 45 |
| | | | Diethanolamine (B-2) | — | — | — | — | — | — | — | — |
| | | | Cyclohexylamine EO adduct (B-3) | — | — | — | — | — | — | — | — |
| | Antioxidant (C) | | Phenolic antioxidant (C-1) | — | 5 | 5 | 5 | 5 | 5 | 5 | 5 |
| | | | Amine antioxidant (C-2) | — | — | — | — | — | — | — | — |
| | Water-insoluble polyether (D) | | 1,4-Butanediol EO/THF adduct (D-1) | 2000 | — | — | — | — | — | — | — |
| Total | | | | | 1000 | 1000 | 1000 | 1000 | 1000 | 1000 | 1000 |
| Physical properties | | | Surface tention (mN/m) | | 55 | 55 | 55 | 55 | 55 | 55 | 55 |
| | | | Kinetic viscosity ($mm^2/s$) | | 86 | 144 | 182 | 80 | 118 | 850 | 104 |
| Property evaluation | | | Biodegradability | | Good | Good | Good | Good | Good | Good | Good |
| | | | Lubricity (friction coefficient) | | 0.12 | 0.11 | 0.10 | 0.10 | 0.11 | 0.12 | 0.11 |
| | | | Anti-corrosion properties | | Good | Good | Good | Good | Good | Good | Good |
| | | | Toxicity | | Good | Good | Good | Good | Good | Good | Good |

| | | | | Molecular weight | Example 24 S24 | 25 S25 | 26 S26 | 27 S27 | 28 S28 | 29 S29 | 30 S30 |
|---|---|---|---|---|---|---|---|---|---|---|---|
| Material | Water-soluble base (A) | Polyether (A1) | PEG-200 (A1-1-1) | 200 | — | — | — | — | — | — | — |
| | | | PEG-300 (A1-1-2) | 300 | — | — | — | 850 | 900 | — | — |
| | | | PEG-1000 (A1-1-3) | 1000 | — | — | — | — | — | — | — |
| | | | Methanol EO adduct (A1-1-4) | 500 | — | 500 | — | — | — | — | — |
| | | | Propanol EO/PO adduct (A1-1-5) | 1000 | — | — | — | — | — | — | — |
| | | | Butanol EO/PO adduct (A1-1-6) | 1500 | — | — | — | — | — | — | — |
| | | | Butanol EO/PO adduct (A1-1-7) | 4000 | — | — | — | — | — | — | — |
| | | | Glycerol EO adduct (A1-1-8) | 500 | 450 | — | — | — | — | — | — |
| | | | Glycerol EO/PO adduct (A1-1-9) | 2000 | — | — | — | — | — | — | — |
| | | | Trimethylolpropane EO/PO adduct (A1-1-10) | 1000 | — | — | — | — | — | — | — |
| | | | Pentaerythritol EO/PO adduct (A1-1-11) | 5000 | 500 | — | — | — | — | — | — |
| | | | Sorbitol EO/PO adduct (A1-1-12) | 1500 | — | — | — | — | — | — | — |
| | | | Sorbitol EO/PO adduct (A1-1-13) | 6000 | — | 450 | — | — | — | — | — |
| | | | PG (A1-1-14) | 76 | — | — | — | — | — | — | — |
| | | | EG-M (A1-1-15) | 76 | — | — | — | — | — | — | — |
| | | | EG-EO/THF (A1-1-16) | 5000 | — | — | — | — | — | — | — |

TABLE 2-continued

| | | | | | | | | | | |
|---|---|---|---|---|---|---|---|---|---|---|
| | | Sorbitol EO/THF adduct (A1-1-17) | 9000 | — | — | — | — | — | — | — |
| | | Sorbitol EO adduct (A1-1-18) | 2000 | — | — | — | — | — | 950 | — |
| | | Polyethylene glycol dimethyl ether (A1-1-19) | 500 | — | — | — | — | — | — | 950 |
| | | Sorbitan mono-fatty acid ester EO adduct (A1-2-1) | 1300 | — | — | — | — | — | — | — |
| | | Sorbitan mono-fatty acid ester EO/PO adduct (A1-2-2) | 4000 | — | — | — | — | — | — | — |
| | | Polyetherpolyester (A1-3-1) | 1000 | — | — | 950 | — | — | — | — |
| | | Polyetherpolyester (A1-3-2) | 8000 | — | — | — | 100 | — | — | — |
| | | Polyetherpolyester (A1-3-3) | 24300 | — | — | — | — | 50 | — | — |
| | | Polyamide polyamine EO/PO adduct (A1-4-1) | 190000 | — | — | — | — | — | — | — |
| | Cellulose derivative (A2) | Carboxymethyl cellulose (A-2) | 90000 | — | — | — | — | — | — | — |
| | Starch (A3) | Starch (derived from corn) (A-3) | — | — | — | — | — | — | — | — |
| | Polyvinyl alcohol (A4) | Polyvinyl alcohol (A-4) | — | — | — | — | — | — | — | — |
| Corrosion inhibitor (B) | | Triethanolamine (B-1) | — | 45 | 45 | 45 | 45 | 45 | 45 | 45 |
| | | Diethanolamine (B-2) | — | — | — | — | — | — | — | — |
| | | Cyclohexylamine EO adduct (B-3) | — | — | — | — | — | — | — | — |
| Antioxidant (C) | | Phenolic antioxidant (C-1) | — | 5 | 5 | 5 | 5 | 5 | 5 | 5 |
| | | Amine antioxidant (C-2) | — | — | — | — | — | — | — | — |
| Water-insoluble polyether (D) | | 1,4-Butanediol EO/THF adduct (D-1) | 2000 | — | — | — | — | — | — | — |
| Total | | | | 1000 | 1000 | 1000 | 1000 | 1000 | 1000 | 1000 |
| Physical properties | | Surface tention (mN/m) | | 55 | 55 | 55 | 55 | 55 | 51 | 48 |
| | | Kinetic viscosity ($mm^2/s$) | | 157 | 135 | 350 | 214 | 92 | 185 | 51 |
| Property evaluation | | Biodegradability | | Good | Good | Good | Good | Good | Good | Good |
| | | Lubricity (friction coefficient) | | 0.12 | 0.11 | 0.13 | 0.12 | 0.12 | 0.10 | 0.12 |
| | | Anti-corrosion properties | | Good | Good | Good | Good | Good | Good | Good |
| | | Toxicity | | Good | Good | Good | Good | Good | Good | Good |

TABLE 3

| | | | | | Comparative Example | | | | |
|---|---|---|---|---|---|---|---|---|---|
| | | | | Molecular weight | 1 H1 | 2 H2 | 3 H3 | 4 H4 | 5 H5 |
| Material | Water-soluble base (A) | Polyether (A1) | PEG-200 (A1-1-1) | 200 | — | — | — | — | — |
| | | | PEG-300 (A1-1-2) | 300 | — | — | 1000 | — | — |
| | | | EG-EO/THF (A1-1-16) | 5000 | — | — | — | — | 100 |
| | | | Sorbitol EO/THF adduct (A1-1-17) | 9000 | — | — | — | — | — |
| | | | Sorbitan mono-fatty acid ester EO adduct (A1-2-1) | 1300 | — | — | — | — | 100 |
| | | | Sorbitan mono-fatty acid ester EO/PO adduct (A1-2-2) | 4000 | — | — | — | 400 | — |
| | | | Polyamide polyamine EO/PO adduct (A1-4-1) | 190000 | — | — | — | — | — |
| | | | 1,6-hexylene glycol EO/PO adduct (A1-1-20) | 18000 | — | — | — | — | — |
| | | Polyvinyl alcohol (A4) | Polyvinyl alcohol (A-4) | — | — | 100 | — | — | — |
| | Corrosion inhibitor (B) | | Triethanolamine (B-1) | — | 395 | 395 | — | — | — |
| | | | Diethanolamine (B-2) | — | — | — | — | — | — |
| | | | Cyclohexylamine EO adduct (B-3) | — | — | — | — | — | — |
| | | | DSA (B-4) | — | — | — | — | — | — |
| | | | Oleamide (B-5) | — | — | — | — | — | — |
| | | | Sodium lauryl sarcosinate (B-6) | — | — | — | — | — | — |
| | | | Sodium oleyl sarcosinate (B-7) | — | — | — | — | — | — |
| | Antioxidant (C) | | Phenolic antioxidant (C-1) | — | 5 | 5 | — | — | — |
| | | | Amine antioxidant (C-2) | — | — | — | — | — | — |
| | Water-insoluble polyether (D) | | 1,4-Butanediol EO/THF adduct (D-1) | 2000 | 600 | 500 | — | 600 | — |
| | | | PPG-1000 (D-2) | 1000 | — | — | — | — | 800 |
| | pH adjuster | | KOH | — | — | — | — | — | — |
| | Water | | | — | — | — | — | — | — |
| Total | | | | | 1000 | 1000 | 1000 | 1000 | 1000 |
| Physical properties | | | Surface tention (mN/m) | | 42 | 42 | 55 | 41 | 40 |
| | | | Kinetic viscosity ($mm^2/s$) | | 200 | 980 | 30 | 35 | 39 |
| Property evaluation | | | Biodegradability | | Bad | Bad | Good | Good | Bad |
| | | | Lubricity (friction coefficient) | | 0.10 | 0.11 | 0.47 | 0.12 | 0.14 |
| | | | Anti-corrosion properties | | Good | Good | Bad | Unacceptable | Unacceptable |
| | | | Toxicity | | Bad | Bad | Good | Good | Good |

TABLE 3-continued

| | | | | Molecular weight | Comparative Example 6 H6 | 7 H7 | 8 H8 | 9 H9 | 10 H10 |
|---|---|---|---|---|---|---|---|---|---|
| Material | Water-soluble base (A) | Polyether (A1) | PEG-200 (A1-1-1) | 200 | 850 | — | — | — | 846 |
| | | | PEG-300 (A1-1-2) | 300 | — | 860 | 940 | 870 | — |
| | | | EG-EO/THF (A1-1-16) | 5000 | — | — | — | — | — |
| | | | Sorbitol EO/THF adduct (A1-1-17) | 9000 | — | — | — | — | — |
| | | | Sorbitan mono-fatty acid ester EO adduct (A1-2-1) | 1300 | — | — | — | — | — |
| | | | Sorbitan mono-fatty acid ester EO/PO adduct (A1-2-2) | 4000 | — | — | — | — | — |
| | | | Polyamide polyamine EO/PO adduct (A1-4-1) | 190000 | — | 60 | 30 | 55 | 54 |
| | | | 1,6-hexylene glycol EO/PO adduct (A1-1-20) | 18000 | 100 | — | — | — | — |
| | | Polyvinyl alcohol (A4) | Polyvinyl alcohol (A-4) | — | — | — | — | — | — |
| | Corrosion inhibitor (B) | | Triethanolamine (B-1) | — | 30 | — | — | — | — |
| | | | Diethanolamine (B-2) | — | — | — | — | — | 6 |
| | | | Cyclohexylamine EO adduct (B-3) | — | — | 25 | — | — | 50 |
| | | | DSA (B-4) | — | — | 20 | 10 | — | 20 |
| | | | Oleamide (B-5) | — | — | — | 20 | 5 | 19 |
| | | | Sodium lauryl sarcosinate (B-6) | — | 20 | — | — | — | — |
| | | | Sodium oleyl sarcosinate (B-7) | — | — | — | — | 15 | — |
| | Antioxidant (C) | | Phenolic antioxidant (C-1) | — | — | — | — | — | 5 |
| | | | Amine antioxidant (C-2) | — | — | — | — | — | — |
| | Water-insoluble polyether (D) | | 1,4-Butanediol EO/THF adduct (D-1) | 2000 | — | — | — | — | — |
| | | | PPG-1000 (D-2) | 1000 | — | — | — | — | — |
| | pH adjuster | | KOH | — | — | 15 | — | — | — |
| | Water | | | — | — | 20 | — | — | — |
| Total | | | | | 1000 | 1000 | 1000 | 945 | 1000 |
| Physical properties | | | Surface tention (mN/m) | | 30 | 30 | 30 | 30 | 30 |
| | | | Kinetic viscosity ($mm^2/s$) | | 25 | 91 | 50 | 86 | 72 |
| Property evaluation | | | Biodegradability | | Good | Good | Good | Good | Good |
| | | | Lubricity (friction coefficient) | | 0.11 | 0.11 | 0.12 | 0.11 | 0.14 |
| | | | Anti-corrosion properties | | Good | Good | Good | Good | Good |
| | | | Toxicity | | Bad | Bad | Bad | Bad | Bad |

Evaluation Example

The biodegradability, the lubricity, the anti-corrosion properties, and the toxicity of the obtained water-soluble lubricating oils were tested.

The test methods are described below. The results are shown in Tables 1 to 3.

(1) Biodegradability

The degree of biodegradation was measured by measuring TOC before and after 28-day cultivation in accordance with the OECD test method 301C. The activated sludge used was purchased from Chemicals Evaluation and Research Institute, Japan.

Good: degree of biodegradation of 60% or more

Bad: degree of biodegradation of less than 60%

(2) Lubricity

The lubricity was evaluated by measuring the friction coefficient in point contact (load: 100 N) between a steel ball and a flat steel disc and observing the wear diameter on the steel ball using an oscillating friction and wear tester (SRV tester, available from Optimol Instruments). The test conditions were as follows.

Amplitude: 2 mm, Frequency: 50 Hz, Temperature: 30° C. Time: 10 minutes

Friction coefficient: average in 10 minutes (3) Anti-corrosion properties

A measurement was performed in accordance with "Lubricants—Determination of rust-preventing characteristics" (JIS K 2510).

The water-soluble lubricating oil was mixed with sea water in an amount of 10% by weight based on the weight of the water-soluble lubricating oil. A polished and cleaned bar steel (S20C) was immersed in the mixture at 60° C. for three days. Thereafter, the formation of corrosion was observed. The anti-corrosion properties were evaluated in accordance with the following criteria. During the immersion, the mixture was kept stirred.

Good: No corrosion (the case where no corrosion was observed, or the case where corrosion was observed in an area 5% or less of the specimen surface, the corrosion had a diameter of 1 mm or less, and the number of spots of the corrosion was 6 or less) Unacceptable: Slight corrosion occurred (the case where corrosion was observed in an area 5% or less of the specimen surface and the corrosion failed to meet the criteria for "Good")

Bad: Corrosion occurred (the case where corrosion was observed in an area more than 5% of the specimen surface)

(4) Toxicity

The toxicity was measured in accordance with the OECD test method 203 "Fish acute toxicity test".

LC50 was obtained using *Oryzias latipes* as test fish. The exposure time was 96 hours. The toxicity was evaluated in accordance with the following criteria.

Good: LC50 of 500 mg/L or more

Bad: LC50 of less than 500 mg/L

Tables 1 to 3 show that the water-soluble lubricating oils of the examples were excellent in all of the biodegradability, the lubricity, the anti-corrosion properties, and the low toxicity. The lubricating oils of the comparative examples were inferior to those of the examples in one or more of the biodegradability, the lubricity, the anti-corrosion properties, and the toxicity.

INDUSTRIAL APPLICABILITY

The water-soluble lubricating oil of the present invention is soluble in water and excellent in the lubricity and the anti-corrosion properties. The mixture obtained in the way described above can be suitably used as is as, for example, a water-soluble operating oil, a water-soluble bearing oil, or a water-soluble gear oil for automobiles, constructing machines, ships, metal processing machines, and the like.

Even if the water-soluble lubricating oil of the present invention leaks into seas, the water-soluble lubricating oil of the present invention shows high biodegradability and high water-solubility and has low toxicity. The lubricating oil of the present invention is thus especially suitable as a water-soluble lubricating oil for ships.

The invention claimed is:

1. A water-soluble lubricating oil, comprising:

a water-soluble base (A) comprising at least one polyether (A1), a corrosion inhibitor (B), and an antioxidant (C);

wherein the polyether (A1) comprises a polyether (A1-1) represented by formula (1), $$R^1\text{—}[O\text{—}(A^1O)_j\text{—}R^2]_k \quad (1)$$

wherein $R^1$ is hydrogen or a hydrocarbon group having a valence of k and 1 to 12 carbon atoms; $A^1$ is an ethylene group; $R^2$ is hydrogen or a hydrocarbon group having 1 to 8 carbon atoms; k is an integer of 1 to 6; and j is an integer to allow the polyether (A1-1) to have a number average molecular weight of 62 to 8,000, and wherein the corrosion inhibitor (B) comprises at least one corrosion inhibitor selected from the group consisting of a triethanolamine and a cyclohexylamine EO adduct, wherein the water-soluble lubricating oil contains the polyether (A1) in an amount of 88.0 to 98.9% by weight, the corrosion inhibitor (B) in an amount of 1.0 to 10.0% by weight, and the antioxidant (C) in an amount of 0.1 to 2.0% by weight, based on the total weight of the polyether (A1), the corrosion inhibitor (B), and the antioxidant (C), and wherein when the water-soluble lubricating oil is measured by a pendant-drop method using a 0.1% by weight aqueous solution of the water-soluble lubricating oil, the water-soluble lubricating oil has a surface tension of 31 mN/m or higher.

* * * * *